US007296444B2

(12) United States Patent
Mae et al.

(10) Patent No.: US 7,296,444 B2
(45) Date of Patent: Nov. 20, 2007

(54) ELECTRIC WASHING MACHINE

(75) Inventors: Shinji Mae, Moriguchi (JP); Akira Okuno, Hefel (JP); Koichi Kuroda, Moriguchi (JP); Masakazu Matsumoto, Moriguchi (JP); Yasushi Araki, Moriguchi (JP); Kiyoshi Sarada, Moriguchi (JP); Yoshikazu Banba, Moriguchi (JP); Kenji Yoshida, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 631 days.

(21) Appl. No.: 10/472,967

(22) PCT Filed: Mar. 27, 2002

(86) PCT No.: PCT/JP02/02976

§ 371 (c)(1),
(2), (4) Date: Mar. 19, 2004

(87) PCT Pub. No.: WO02/081809

PCT Pub. Date: Oct. 17, 2002

(65) Prior Publication Data

US 2004/0144136 A1 Jul. 29, 2004

(30) Foreign Application Priority Data

Apr. 5, 2001 (JP) ..... 2001-106923
Apr. 27, 2001 (JP) ..... 2001-133254

(51) Int. Cl.
*D06F 33/02* (2006.01)
*D06F 39/02* (2006.01)

(52) U.S. Cl. ..... 68/12.04; 68/12.19; 68/17 R; 68/13 A

(58) Field of Classification Search ..... 68/12.19, 68/13 A, 17 R, 207, 12.04
See application file for complete search history.

(56) References Cited

U.S. PATENT DOCUMENTS 4,402,197 A 9/1983 Groult et al.
4,434,629 A * 3/1984 Bianchi et al. ..... 68/13 A
5,960,501 A * 10/1999 Burdick ..... 8/158

(Continued)

FOREIGN PATENT DOCUMENTS

CN 1272567 A 11/2000

(Continued)

*Primary Examiner*—Joseph L. Perrin
(74) *Attorney, Agent, or Firm*—Rabin & Berdo, PC

(57) ABSTRACT

An electric washing machine according to the present invention performs a washing process for washing laundry without the use of a detergent by generating water streams in an outer tub (2) containing an electrolyzed liquid produced through electrolysis by an electrolyzing device (31) when a zero detergent course is selected by a user. The electrolyzing device (31) is provided as a water treatment unit (60) attached to a lower portion of an outer side surface (66) of the outer tub (2), and includes a thin-box-shaped electrolyzing chamber (32), a pair of electrodes (33) supported at opposite edges thereof, and a pair of water communication paths (34, 35). The pair of water communication paths (34, 35) are disposed in a vertically juxtaposed relation to connect the outer tub (2) to the electrolyzing chamber (32) with the intervention of packings (81). Thus, an assembling operation and the like can conveniently be performed, and water can efficiently be electrolyzed for use in the washing process.

6 Claims, 8 Drawing Sheets

U.S. PATENT DOCUMENTS

| | | | | |
|---|---|---|---|---|
| 6,507,965 | B2 * | 1/2003 | Kown | 8/158 |
| 6,513,180 | B2 * | 2/2003 | Hamand | 8/158 |

FOREIGN PATENT DOCUMENTS

| | | | |
|---|---|---|---|
| EP | 0 536 542 | A1 | 4/1993 |
| GB | 2 292 391 | A | 2/1996 |
| JP | 57-500048 | | 1/1982 |
| JP | 2000-312795 | | 1/1982 |
| JP | 61-154892 | | 9/1986 |
| JP | 61-263485 | | 11/1986 |
| JP | 61-280883 | | 12/1986 |
| JP | 62-27590 | | 2/1987 |
| JP | 63-37185 | | 3/1988 |
| JP | 4-20394 | | 1/1992 |
| JP | 05-068784 | | 3/1993 |
| JP | 5-123488 | | 5/1993 |
| JP | 5-123489 | | 5/1993 |
| JP | 5-200183 | | 8/1993 |
| JP | 6-15090 | | 1/1994 |
| JP | 6-79092 | | 3/1994 |
| JP | 6-182089 | | 7/1994 |
| JP | 7-80185 | | 3/1995 |
| JP | 8-57190 | | 3/1996 |
| JP | 08-196776 | | 8/1996 |
| JP | 9-29254 | | 2/1997 |
| JP | 9-108490 | | 4/1997 |
| JP | 10-258258 | | 9/1998 |
| JP | 11-137888 | | 5/1999 |
| JP | 11-244857 | | 9/1999 |
| JP | 2000-312797 | | 11/2000 |
| JP | 2001-170392 | | 6/2001 |
| JP | 2001-353393 | | 12/2001 |
| KR | 2000-0003802 | | 1/2000 |
| KR | 2000-0045174 | | 7/2000 |
| KR | 10-391076 | | 6/2003 |

* cited by examiner

ELECTRIC WASHING MACHINE

TECHNICAL FIELD

The present invention relates to an electric washing machine.

PRIOR ART

Electric washing machines usually perform a washing process with the use of a detergent.

SUMMARY OF THE INVENTION

It is a main object of the present invention to provide an electric washing machine which is capable of washing laundry without the use of a detergent.

In accordance with a first aspect of the present invention, there is provided an electric washing machine comprising: a washing tub for containing laundry; water stream generating means for generating water streams in the washing tub; water treatment means for performing a specific treatment on tap water to be supplied into the washing tub or tap water supplied into the washing tub to impart the water with a cleaning capability without addition of a detergent; storage means which stores therein a sequence for a first washing course in which the laundry is washed by generating water streams in the washing tub which contains a detergent solution prepared by adding the detergent into the tap water, and a sequence for a second washing course in which the laundry is washed without the use of the detergent by generating water streams in the washing tub which contains a cleaning liquid imparted with the cleaning capability by treating the tap water by the water treatment means; selecting means for allowing a user to select the first washing course or the second washing course; and control means for controlling operations of the water stream generating means and the water treatment means on the basis of the sequence for the washing course selected by the selecting means to perform a washing process in the selected washing course.

More specifically, the water treatment means includes a pair of electrodes for electrolysis of the tap water, and is adapted to produce the cleaning liquid by electrolyzing the tap water through energization of the pair of electrodes.

In the aforesaid arrangement, the machine preferably further comprises load detecting means for detecting a load of the laundry and information means for notifying a detergent amount according to the load detected by the load detecting means, wherein the control means actuates the load detecting means for the detection of the load and causes the information means to notify the detergent amount according to the detected load in the washing process of the first washing course, and prohibits the information means from notifying the detergent amount in the washing process of the second washing course.

The machine preferably further comprises second information means for notifying that no detergent is added, wherein the control means actuates the second information means in the washing process of the second washing course.

Alternatively, the machine preferably further comprises load detecting means for detecting a load of the laundry, and adding means for adding the detergent in an amount according to the load detected by the load detecting means, wherein the control means actuates the load detecting means for the detection of the load and causes the adding means to add the detergent in the amount according to the detected load in the washing process of the first washing course, and prohibits the adding means from adding the detergent in the washing process of the second washing course.

In the aforesaid arrangements, where the first washing course is selected by the user, the water streams are generated in the washing tub containing the detergent solution (prepared by adding the detergent into the tap water) for washing the laundry in the washing process. More specifically, the load of the laundry contained in the washing tub is detected. Then, the detergent amount according to the detected load is notified (by display or voice), and the user adds a proper amount of the detergent on the basis of the notification. Alternatively, the detergent is automatically added according to the detected load.

A place where the detergent is added is, for example, the washing tub or a detergent box. That is, the place may be where the detergent is mixed with the water contained in the washing tub.

When the water containing the detergent (detergent solution) is contained in the washing tub, the water streams are generated for washing the laundry. Dirt adhering to the laundry is removed by the effect of the detergent and the effect of the water streams.

Where the second washing course is selected by the user, the water streams are generated in the washing tub containing the cleaning liquid (e.g., electrolyzed liquid) produced through the treatment by the water treatment means for washing the laundry without the use of the detergent in the washing process.

More specifically, the pair of electrodes are disposed in a space where the tap water in the washing tub can be electrolyzed, for example, in the washing tub or a chamber communicating with the washing tub. First, the water is retained in the washing tub. Then, the water in the washing tub is electrolyzed through energization of the pair of electrodes for production of the electrolyzed water as the cleaning liquid. In the electrolyzed water contained in the washing tub, the water streams are generated for washing the laundry. In this washing process, the information on the detergent amount according to the load is not given, but addition of no detergent is notified. Alternatively, the automatic addition of the detergent is not effected.

The tap water contains very small amounts of impurities such as iron, calcium, magnesium and chlorine, and the electrolysis thereof provides the following effects. That is, the electrolyzed water is neutral to alkaline. In addition, active oxygen is generated. Further, hypochlorous acid and hypochlorous ions are generated. Dirt adhering to the laundry is removed by the effect of the alkaline water, the effect of the active oxygen and the effect of the water streams. In addition, the laundry is sterilized by the effect of hypochlorous acid and hypochlorous ions.

The washing operation by the water streams may be performed during the water treatment (electrolysis), or after the water treatment. Rather than the treatment (electrolysis) of the tap water contained in the washing tub, the water treatment means (the pair of electrodes) may be provided upstream of the washing tub, so that the tap water is treated for the production of the cleaning liquid which is in turn supplied into the washing tub.

With the aforesaid arrangements, the washing course for washing the laundry without the use of the detergent can be realized, so that the amount of the detergent to be used can drastically be reduced.

Further, the information on the detergent amount according to the load is provided in the first washing course employing the detergent, and is not provided in the second washing course employing no detergent. Therefore, the proper amount of the detergent can be added without any excess or shortage in the first washing course, and the use of no detergent can expressly be notified to prevent the user from mistakenly adding the detergent in the second washing course employing no detergent.

In the second washing course, the use of no detergent is notified, thereby assuredly preventing the user from adding the detergent.

The detergent is automatically added in an amount according to the load in the first washing course employing the detergent, and the automatic addition of the detergent is not effected in the second washing course employing no detergent. Therefore, the proper amount of the detergent can be added without any excess or shortage in the first washing course, and wasteful use of the detergent can be prevented in the second washing course employing no detergent.

In accordance with another aspect of the present invention, there is provided an electric washing machine which is adapted to selectively effect a first washing course in which laundry is washed with the use of a detergent and a second washing course in which the laundry is washed in a manner different from the first washing course without the use of the detergent.

With the aforesaid arrangement, the washing course for washing the laundry without the use of the detergent is realized, so that the amount of the detergent to be used can drastically be reduced.

In accordance with further another aspect of the present invention, there is provided an electric washing machine comprising a water treatment unit for electrolyzing water in use for a washing process to impart the water with a cleaning capability without addition of a detergent, the water treatment unit being attached to the outside of a washing tub.

Thus, the amount of the detergent to be used can be reduced, and the water treatment unit can easily be handled from the outside of the washing tub. Therefore, a mounting operation for mounting the water treatment unit on the washing tub, a maintenance operation for the water treatment unit and a disassembling operation for recycling, for example, can be facilitated.

In the aforesaid arrangement, the water treatment unit preferably includes an electrolyzing chamber, at least one pair of electrodes disposed in the electrolyzing chamber, and a pair of water communication paths extending from the electrolyzing chamber, the pair of water communication paths being connected to the washing tub, wherein the water flows into the electrolyzing chamber from the washing tub through one of the water communication paths, and the water treated in the electrolyzing chamber flows out into the washing tub through the other water communication path.

Thus, the water treatment unit can unitarily be handled in the assembling and maintenance operations, so that these operations are further facilitated.

Since the pair of water communication paths ensure efficient water communication between the electrolyzing chamber and the washing tub, the treated water can be supplied into the washing tub for efficient use in the washing process without waste, and the water from the washing tub is caused to flow within the electrolyzing chamber for efficient electrolysis.

In the aforesaid arrangement, the electrolyzing chamber preferably has a thin box shape having a smaller depth with respect to an outer surface of the washing tub, and the electrodes preferably each have a plate shape corresponding to the thin box shape of the electrolyzing chamber. The plate-shaped electrodes are preferably disposed at a predetermined inter-electrode pitch with opposite edges thereof being supported.

Thus, the projection of the water treatment unit from the outer surface of the washing tub can be reduced for space saving.

Since the electrodes are held at the opposite edges thereof in the box-shaped electrolyzing chamber, the water treatment unit can be handled without careful attention. Therefore, the assembling, maintenance and disassembling operations can be facilitated.

In the aforesaid arrangement, the electrolyzing chamber is preferably mounted on an outer side surface of the washing tub. The one water communication path (inlet path) preferably extends from a lower portion of the electrolyzing chamber, and the other water communication path (outlet path) preferably extends from an upper portion of the electrolyzing chamber. The water communication paths are preferably connected to the washing tub with the intervention of packings.

With the use of the packings, dimensional errors can be accommodated when the water treatment unit is mounted on the washing tub, so that the mounting can easily be achieved. In addition, sealing of gaps between the water communication paths and the washing tub can be achieved.

Since the pair of water communication paths are provided at different vertical positions of the thin-box-shaped electrolyzing chamber attached to the outer side surface of the washing tub, vertical water flow is facilitated for efficient electrolysis.

In the aforesaid arrangement, the upper portion of the electrolyzing chamber is preferably inclined with one side thereof located at a higher position, and the outlet path preferably extends from the higher position. The inlet path preferably extends from a lower end of the electrolyzing chamber. Thus, the water flow in the electrolyzing chamber can be facilitated.

In the aforesaid arrangement, an air supply port for supplying air is preferably provided at a lower portion of the electrolyzing chamber, whereby the air supplied into the electrolyzing chamber from the air supply port flows into the washing tub through the upper water communication path, and the water contained in the electrolyzing chamber is caused to flow by the air flow. Thus, the water flow in the electrolyzing chamber can be facilitated for efficient electrolysis. In addition, the air is introduced into the washing tub, thereby contributing to improvement of the cleaning capability.

In the aforesaid arrangement, the air is preferably supplied without contact with the electrodes. Thus, reduction in electrolysis efficiency due to the air can be suppressed.

In the aforesaid arrangement, the electrodes preferably each have a round corner, and a spacing between the electrodes and a spacing between each of the electrodes and the electrolyzing chamber are preferably such that lint is prevented from being caught therebetween. Thus, the lint is less liable to adhere onto the electrodes, so that reduction in electrolysis efficiency due to the lint can be prevented.

EMBODIMENTS OF THE INVENTION

A fully automatic washing machine according to one embodiment of the present invention will hereinafter be described with reference to the attached drawings.

Figure 1:
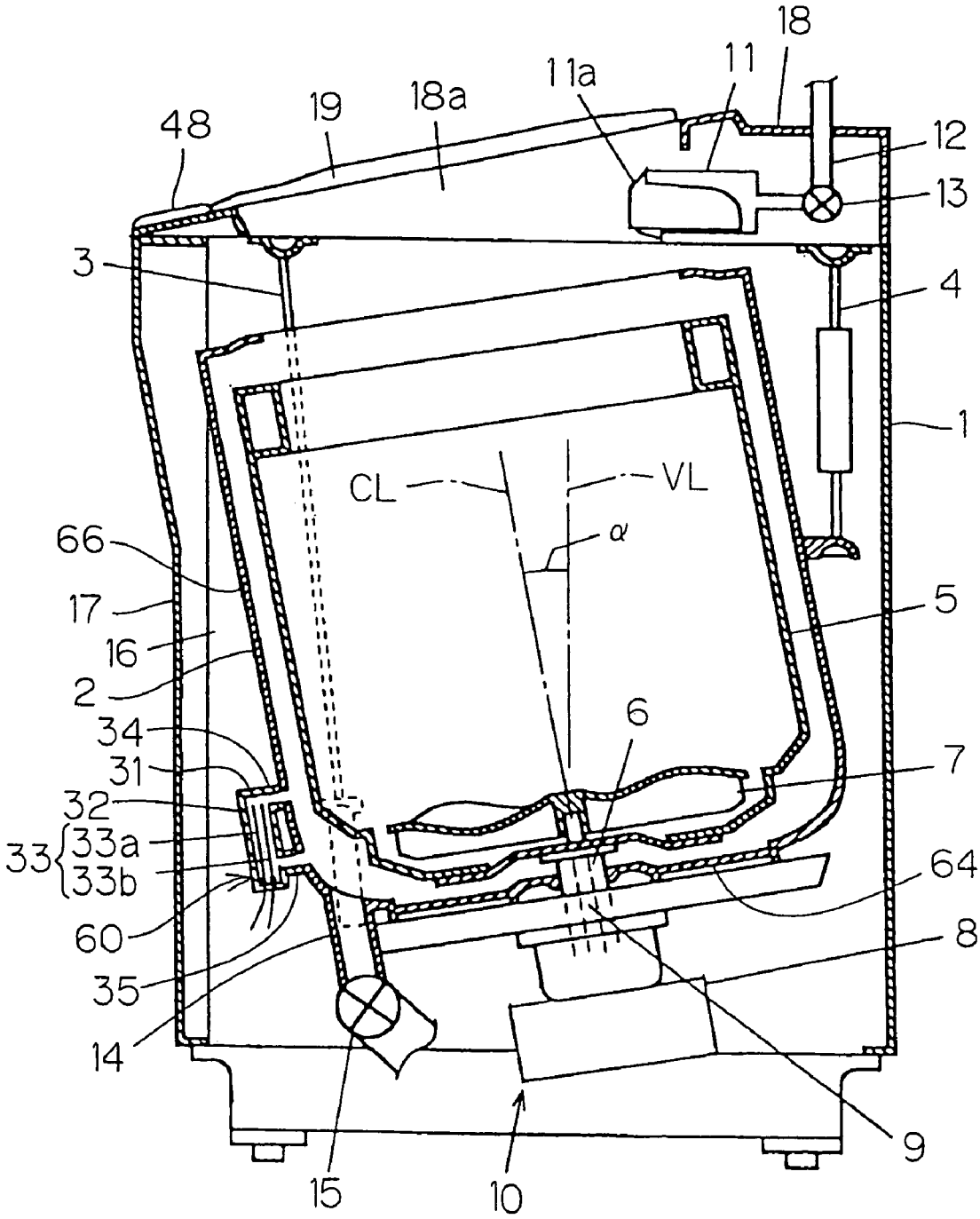
FIG. 1 is a side sectional view of a fully automatic washing machine according to one embodiment of the present invention.

FIG. 1 is a side sectional view illustrating the construction of the fully automatic washing machine according to this embodiment. A bottomed cylindrical outer tub 2 is suspended in a forwardly inclined manner within a housing 1 of the washing machine by front suspension rods 3 and rear suspension rods 4 (though one front suspension rod and one rear suspension rod are shown in the figure, there are two front suspension rods and two rear suspension rods). A front upper portion of the housing 1 projects forward correspondingly to the forward projection of an upper portion of the inclined outer tub 2. The housing 1 has a widely open front portion 16, which is covered with a detachable front panel 17. Therefore, an upper portion of the front panel 17 projects correspondingly to the projection of the upper portion of the outer tub 2.

A washing/dehydration tub (inner tub) 5 having a multiplicity of dehydration perforations formed in a circumferential wall thereof is supported within the outer tub 2 rotatably about a dehydration shaft 6 thereof. The outer tub 2 and the inner tub 5 constitute a washing tub according to the present invention. A pulsator 7 (water stream generating means) for generating water streams for agitation of laundry is disposed on an inner bottom portion of the inner tub 5. A driving mechanism 10 for driving the pulsator 7 and the inner tub 5 is provided at the bottom of the outer tub 2. The driving mechanism 10 includes the dehydration shaft 6, a pulsator shaft 9 provided in the dehydration shaft 6 for rotating the pulsator 7, a motor 8 provided coaxially with the dehydration shaft 6 and the pulsator shaft 9, and a clutch for switchably transmitting power of the motor 8 only to the pulsator shaft 9 or to both the pulsator shaft 9 and the dehydration shaft 6. The driving mechanism 10 principally rotates only the pulsator 7 in one direction or in opposite directions in a washing operation and a rinsing operation, and unitarily rotates the inner tub 5 and the pulsator 7 in one direction (or in a normal direction) in a dehydrating operation. The inner tub 5 is rotated once by each turn of the motor 8. On the other hand, a reduction gear mechanism (not shown) is provided in a middle portion of the pulsator shaft 9, so that the pulsator 7 is rotated according to a reduction radio of the reduction gear mechanism.

A water supply port 11 having a detergent container 11*a* for supplying a detergent contained therein is provided on an upper rear side of the outer tub 2. A water supply tube 12 having a water supply valve 13 provided in a middle portion thereof is connected to the water supply port 11. When the water supply valve 13 is opened, tap water is supplied to the water supply port 11 from an external tap through the water supply tube 12. Thus, the tap water flows downward into the outer tub 2 from the water supply port 11. One end of a water drainage tube 14 is connected to a front bottom portion or lowermost portion of the outer tub 2. The water drainage tube 14 is opened and closed by a water drainage valve 15. The other end of the water drainage tube 14 is connected to an external sewage drain through a self-standing hose not shown. The opening and closing of the water drainage valve 15 are associated with the switching of the aforesaid clutch. When a torque motor (not shown in FIG. 1) is not operated, the pulsator 7 is decoupled from the inner tub 5 so as to be solely rotated with the water drainage valve 15 being closed. When the torque motor is operated to pull a wire to the midst, the pulsator 7 is coupled to the inner tub 5 with the water drainage valve 15 being closed. When the wire is further pulled, the water drainage valve 15 is opened with the pulsator 7 kept coupled to the inner tub 5.

In the washing machine according to this embodiment, the outer tub 2 and the inner tub 5 are inclined forward as described above, so that open tops of the outer tub 2 and the inner tub 5 are directed forward with respect to a vertically upward direction. That is, a center line CL of the outer tub 2 is tilted at a predetermined tilt angle $\alpha$ with respect to a vertical line VL. Thus, a user standing in front of the washing machine can easily view the bottom of the inner tub 5 and easily take out the laundry. A tilt angle $\alpha$ of about 5 degrees to about 20 degrees ensures easy take-out of the laundry, and yet suppresses the forward projection of the housing 1. In this embodiment, the tilt angle $\alpha$ is set at about 10 degrees.

An electrolyzing device 31 as water treatment means is disposed on a lower portion of a circumferential wall of the outer tub 2. The electrolyzing device 31 is provided as a unit separate from the outer tub 2, and fixed to the outer tub 2 by screws or the like. The electrolyzing device 31 is located on a front side of the outer tub 2, and appears when the front panel 17 is removed. This arrangement facilitates the repair and replacement of the electrolyzing device 31.

The electrolyzing device 31 includes an electrolyzing chamber 32 provided separately from the outer tub 2, a pair of electrodes 33 disposed in the electrolyzing chamber 32, an upper water communication path 34 connecting an upper portion 69 of the electrolyzing chamber 32 to the outer tub 2, and a lower water communication path 35 connecting a lower portion of the electrolyzing chamber 32 to the outer tub 2.

The pair of electrodes 33 include a first electrode 33*a* and a second electrode 33*b*. The first electrode 33*a* and the second electrode 33*b* each have a thin square plate shape. The electrolyzing chamber 32 is configured in a thin box shape having a smaller depth (indicated by D1 in FIG. 3) with respect to the circumferential wall of the outer tub 2. The first electrode 33*a* and the second electrode 33*b* are disposed in predetermined spaced relation in the electrolyzing chamber 32 with surfaces thereof facing toward the circumferential wall of the outer tub. This arrangement suppresses the projection of the electrolyzing device 31 provided on the circumferential surface of the outer tub 2. Thus, the electrolyzing device 31 is prevented from bumping against the housing 1 when the outer tub 2 vibrates during the dehydrating operation.

It is also conceivable that the electrolyzing chamber 32 of the electrolyzing device 31 is provided integrally with the outer tub 2 and the electrodes 33 are provided inside the outer tub 2. In this case, however, it is difficult to mount the electrodes 33 in a narrow space inside the outer tub 2 and to take out the electrodes 33 for maintenance and recycling. This is why the electrolyzing device 31 is provided as a unit, i.e., as a water treatment unit 60, which can be mounted outside the outer tub 2.

The water treatment unit 60 is constructed so as to be handled unitarily in the assembling. For example, the water treatment unit has the electrolyzing chamber 32, the pair of electrodes 33 disposed in the electrolyzing chamber 32, and the pair of water communication paths 34, 35 extending from the electrolyzing chamber 32, so as to solely constitute the aforesaid electrolyzing device 31. The electrolyzing chamber 32 and the pair of water communication paths 34, 35 are integrally formed of a synthetic resin.

Figure 2:
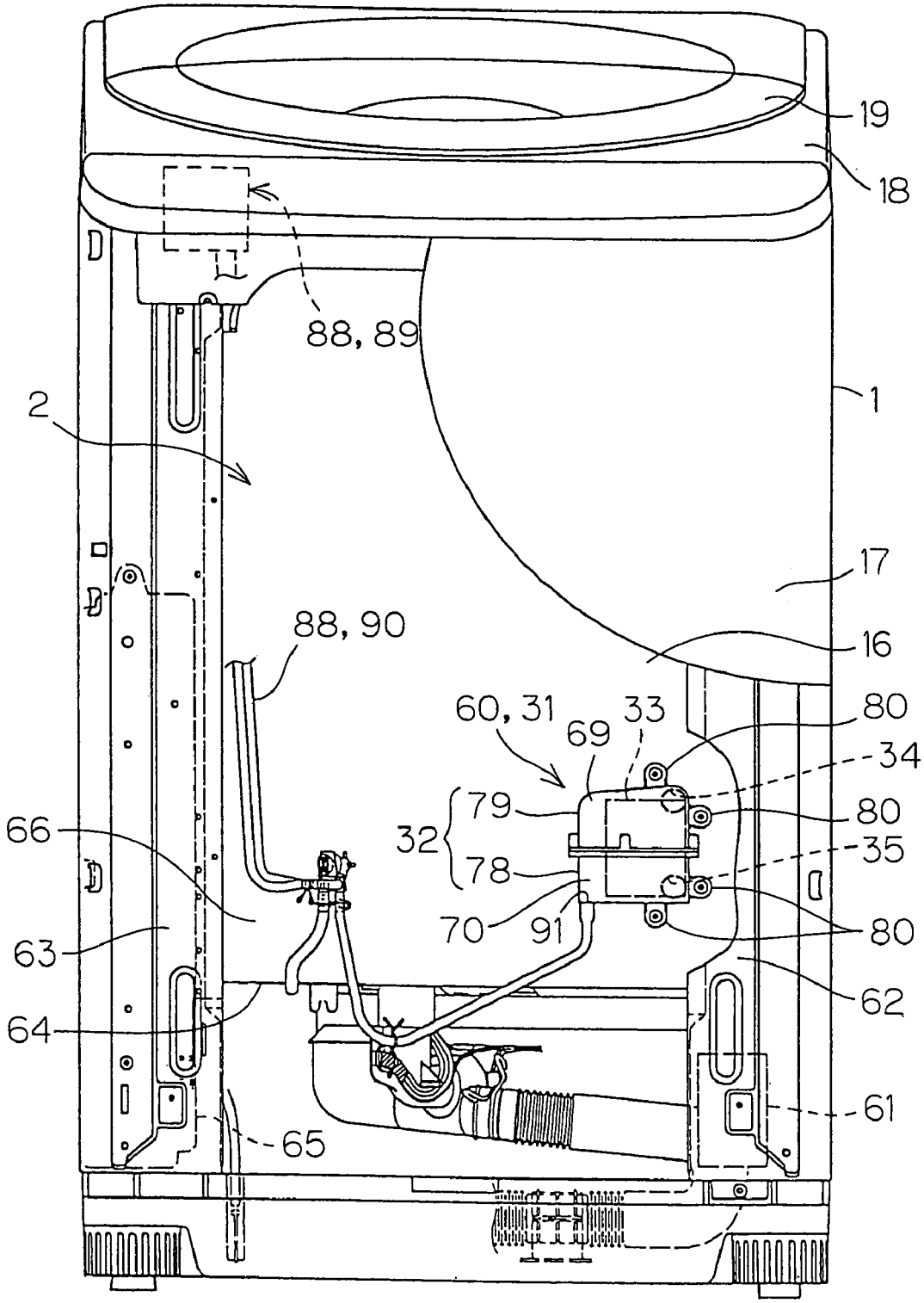
FIG. 2 is a partly sectional front view of the fully automatic washing machine shown in FIG. 1.

The water treatment unit 60 is mounted on a front lower right portion of the outer tub 2 as seen from the front side thereof in FIG. 2 in an open space defined between a corner of the housing 1 and the outer tub 2. An energization circuit 30 (see FIG. 6) is electrically connected to the water treatment unit 60. The energization circuit 30 has a transformer 61 and the like. The transformer 61 which typically has a greater weight is stably fixed to a highly strong front portion 62 of a right corner of the housing 1 as seen from the front side thereof. The transformer 61 may be fixed to the bottom 64 of the outer tub 2. In this case, the vibrations of the outer tub 2 can advantageously be suppressed by utilizing the great weight of the transformer 61.

The water treatment unit 60 and the transformer 61 are located in the vicinity of the open portion 16 of the housing 1 and, therefore, easily accessed through the open portion 16 for an assembling operation, a maintenance operation for repair, replacement or the like, and a disassembling operation for recycling. Further, the water treatment unit 60 and the transformer 61 are closely located, so that electrical connection therebetween is easily established. Since the water treatment unit 60 and the transformer 61 are detachably fixed by screws, the aforesaid operations can advantageously be performed.

The water treatment unit 60 and the transformer 61 are fixed at a position remote from electrical components for controlling motor rotation such as a rotation sensor 24 (see FIG. 6) provided in the motor 8 and a control circuit board 65 fixed to a front left portion 63 of the housing 1 and including an invertor driving section 23 (see FIG. 6), and interconnection components (not shown) connecting these components. Thus, noises caused by the transformer 61 during electrolysis can be prevented from exerting an adverse effect on the control of the rotation of the motor 8.

Figure 3:
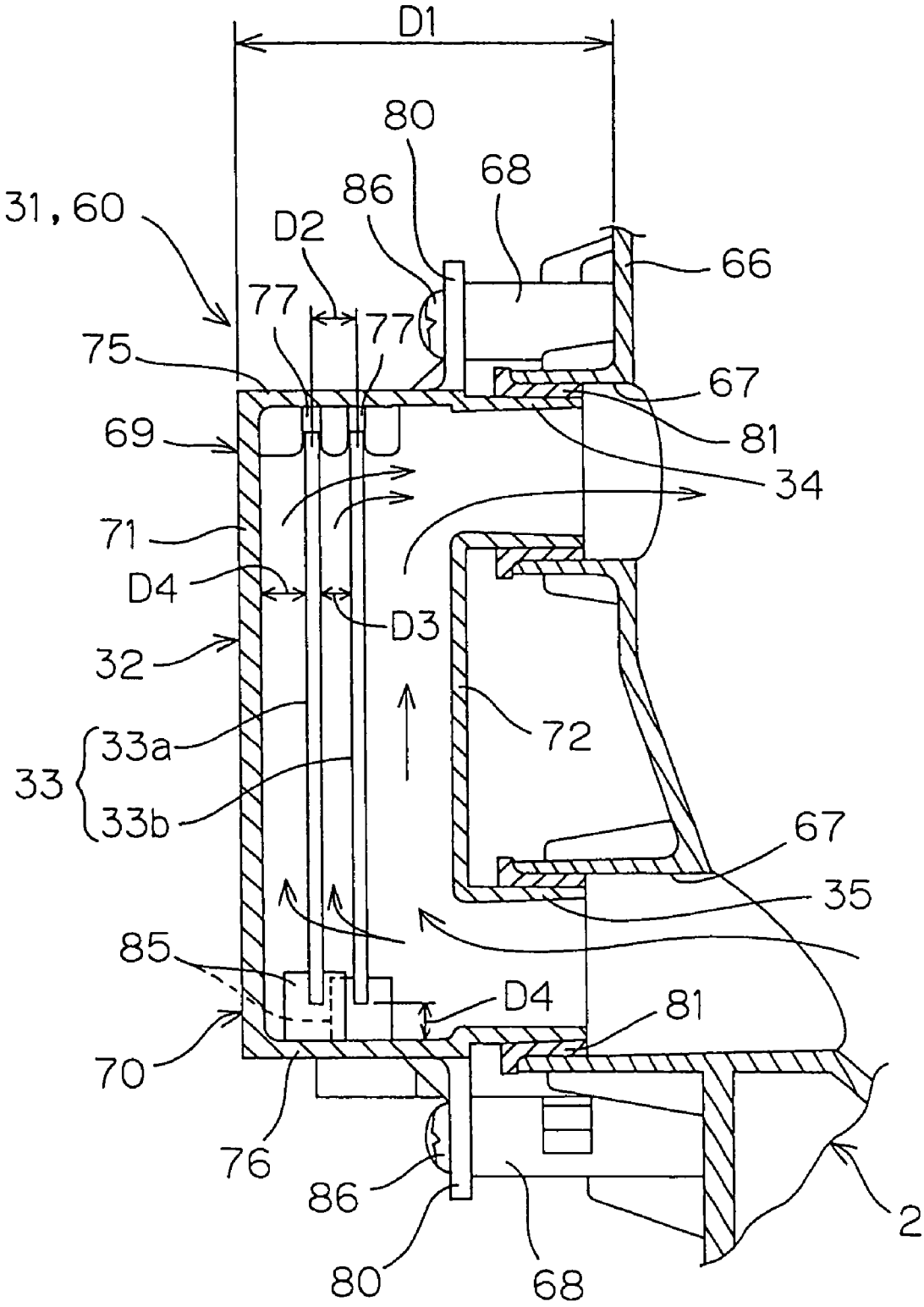
FIG. 3 is a partly sectional side view of a water treatment unit.

As shown in FIG. 3, the electrodes 33 are disposed parallel to the largest face, e.g., a front face portion 71, of the thin-box-shaped electrolyzing chamber 32, and each have a plate shape having a size corresponding to the size of the front face portion 71. Since the electrodes 33 thus have greater areas, a requirement for the surface areas is satisfied by a minimum number of electrodes 33. The electrodes 33 are formed of a metal, and disposed in opposed relation. The plate-shaped electrodes 33 are supported at a predetermined inter-electrode pitch with opposite sides of plate faces thereof or opposite edges thereof being held. Opposite polarities are respectively applied to the pair of electrodes 33 for the electrolysis of the water.

The arrangement of the electrodes 33 is not limited to the pair of electrodes having the opposite polarities. For example, three electrodes 33 may be disposed in juxtaposition with plate surfaces thereof opposed to each other. Alternatively, five electrodes 33 maybe disposed in juxtaposition with plate surfaces thereof opposed to each other. In these cases, the polarities of the electrodes 33 are alternated so that each adjacent pair of electrodes 33 have opposite polarities. What is important is that at least one pair of electrodes 33 are provided. Therefore, the following description is directed to a case where one pair of electrodes 33 are provided.

The vertically opposite edges of the electrodes 33 are held by the electrolyzing chamber 32. Upper edges of the electrodes 33 are held in recesses 77 formed in the electrolyzing chamber 32. These recesses 77 are defined between a pair of ribs projecting inward from a top face portion 75 of the electrolyzing chamber 32. Lower edges of the electrodes 33 are held by a bottom face portion 76 of the electrolyzing chamber 32 via terminal covers 85. The terminal covers 85 cover the lower edges of the electrodes 33, and seal gaps between the bottom face portion 76 of the electrolyzing chamber 32 and the lower edges of the electrodes 33 for prevention of accumulation of lint. The electrodes 33 may be supported at laterally opposite sides thereof.

The inter-electrode pitch (indicated by D2), more specifically, a spacing (indicated by D3) between the electrodes 33, is preferably not smaller than 2 mm and not greater than 5 mm, for example. If the spacing is smaller than 2 mm, the lint is liable to come into a space between the electrodes 33 and adhere on the electrodes, thereby reducing the electrolysis efficiency and the durability. If the spacing is greater than 5 mm, application of a higher voltage is required for maintaining the electrolysis efficiency at a high level, making practical construction difficult. With a spacing of not smaller than 2 mm and not greater than 5 mm, a practically high durability and a high electrolysis efficiency can be realized.

It is conceivable that the electrolyzing chamber 32 is formed of a material different from the material for the outer tub 2 or, alternatively, of the same material as the outer tub 2. In the latter case, the electrolyzing chamber 32 can easily be handled for recycling thereof. For example, the electrolyzing chamber 32 is formed of an olefin resin such as polypropylene (PP). This resin is also employed as the material for the outer tub 2 to impart the outer tub with a chemical resistance to water containing agents such as a detergent and a bleaching agent. Further, addition of a reinforcing material such as glass fibers to the material for the electrolyzing chamber 32 advantageously suppresses reduction in the strength of the tub due to increase in water temperature.

Figure 4:
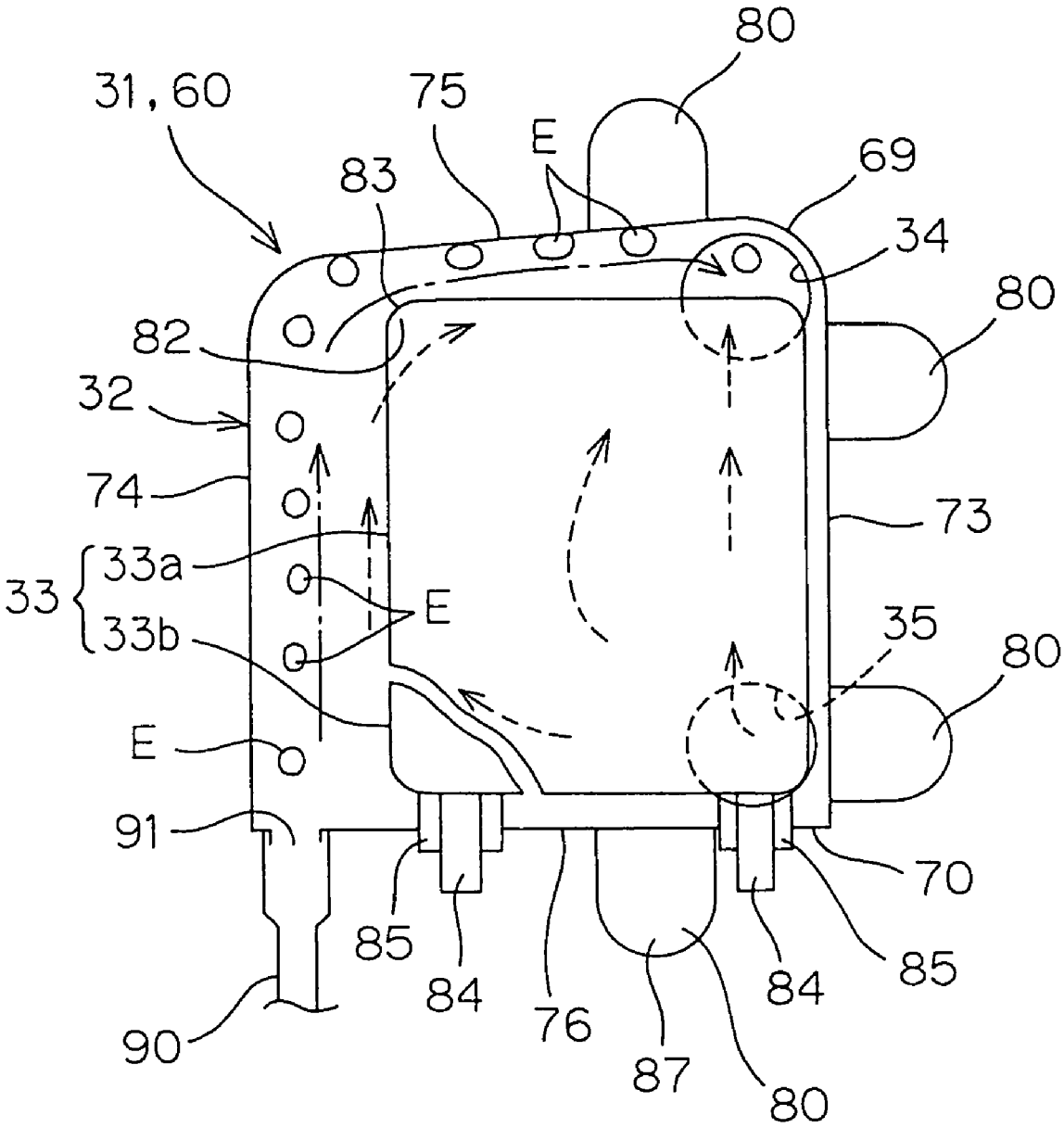
FIG. 4 is a schematic diagram schematically illustrating the construction of the water treatment unit as viewed from the front side thereof.

As shown in FIGS. 3 and 4, the electrolyzing chamber 32 has the bottom face portion 76, the front face portion 71, a rear face portion 72, a right side face portion 73 and a left side face portion 74 which extend upright from the periphery of the bottom face portion 76, and the top face portion 75. The electrodes 33 are disposed in a space defined by the face portions 71 to 76, and water is retained in the space. The electrolyzing chamber 32 is configured so as to have a smaller dimension as measured from the front face portion 71 to the rear face portion 72. The electrodes 33 are disposed generally parallel to the front face portion 71. The electrolyzing chamber 32 is constituted by a pair of vertically separable bodies 78, 79 (see FIG. 2).

An upper portion 69 of the electrolyzing chamber 32 is inclined with one side thereof located at a higher position. That is, the top face portion 75 of the electrolyzing chamber 32 is inclined upward toward the right side thereof as seen from the front side thereof. The upper water communication path 34 extends from a part of the rear face portion 72 at the higher position. The lower water communication path 35 extends from a part of the rear face portion 72 at a lower position of the electrolyzing chamber 32.

The pair of water communication paths 34, 35 are arranged generally parallel to each other in vertically juxtaposed relation. The water communication paths 34, 35 are tubes having a round section and formed integrally with the rear face portion 72 of the electrolyzing chamber 32. The shape of the pair of water communication paths 34, 35 is not limited to the tubular shape, as long as spaces are defined therein for communication between the inside of the electrolyzing chamber 32 and the inside of the outer tub 2 for water passage. It is also conceivable to provide the water communication paths separately from the electrolyzing chamber 32 or integrally with the outer tub 2.

The water flows into the electrolyzing chamber 32 from the outer tub 2 through the lower water communication path 35. Water treated in the electrolyzing chamber 32 flows out into the outer tub 2 through the upper water communication path 34. The water is caused to flow in this manner, for example, by the water streams generated in the outer tub 2 by the rotation of the pulsator 7.

The way of the water flow in the pair of water communication paths 34, 35 is not particularly limited, but it is also conceivable that the water flows in a direction opposite to that described above. It is merely necessary that the pair of water communication paths 34, 35 are provided for the water inlet and the water outlet, and it is also conceivable that at least one of the water communication paths includes a plurality of water communication paths, e.g., three or more water communication paths. It is also conceivable that the pair of water communication paths are provided unitarily or as a single water communication path. For example, the single water communication path is not divided into two water communication paths for the water inlet and the water outlet, but may double as a water inlet path and a water outlet path. The following description is directed to a case where the lower water communication path 35 and the upper water communication path 34 serve as the water inlet path and the water outlet path, respectively.

As shown in FIG. 3, the pair of water communication paths 34, 35 are connected to the outer tub 2 via packings 81. The packings for the water communication paths 34, 35 have the same construction and, therefore, an explanation will be given only to the packing for the water communication path 34.

The packing 81 is a cylindrical elastic component such as composed of a rubber. The packing 81 is fitted around the water communication path 34. The packing 81 is press-fitted in a connection port 67 formed on an outer surface 66 (circumferential wall) of the outer tub 2 externally of the outer tub 2. The packing 81 has a long sealing distance between the tubular water communication path 34 and the connection port 67. The packing 81 is fitted in a predetermined radially compressed manner to seal a gap between the inner circumference of the connection port 67 and the outer circumference of the water communication path 34. The packing 81 is elastically deformable in its radial and axial directions. Thus, the packing 81 accommodates dimensional errors in the connection port 67 and the water communication path 34. Further, the packing 81 can accommodate a dimensional difference between a pitch of the pair of water communication paths 34, 35 and a pitch of the pair of connection ports 67. The packing 81 accommodates thermal deformation of the outer tub 2 occurring when hot water is retained in the outer tub 2. Thus, breakage and water leakage can be prevented.

Besides the cylindrical packing, an O-ring and a sheet packing may be employed as the packing 81.

The electrolyzing chamber 32 has a plurality of fixing portions, e.g., four fixing portions 80, provided in the vicinity of the pair of water communication paths 34, 35 for fixing the electrolyzing chamber 32 to the outer tub 2 by screws. The screws 86 extending through through-holes of the fixing portions 80 are externally screwed into bosses 68 projecting from the outer surface 66 of the outer tub 2.

Terminals 84 of the electrodes 33 extend outward through the bottom face portion 76 of the electrolyzing chamber 32 as shown in FIG. 4. Even if water drops adhere on the outer surface of the electrolyzing chamber 32 due to water condensation and overflow of the water from the washing tub, a short-circuit between the terminals 84 of the pair of electrodes 33 is less liable to occur due to the water drops. Thus, the terminals 84 can electrically be isolated from each other. Further, a separation plate 87 is provided for separating the terminals 84 of the pair of electrodes 33 from each other. The separation plate 87 prevents movement of the water drops to ensure the electrical isolation. The separation plate 87 may double as the fixing portion 80 formed integrally with the electrolyzing chamber 32 for reduction of the number of the components.

The water treatment unit 60 is assembled in the following manner. With the separable bodies 78, 79 of the electrolyzing chamber 32 being separated from each other, the electrodes 33 are set in one 78 of the separable bodies. Then, the pair of separable bodies 78, 79 are combined with each other, and seams thereof are sealed. Thus, the assembling of the water treatment unit 60 is completed. The water treatment unit 60 having the box-shaped electrolyzing chamber 32 per se can be tested, for example, for the sealing property and the electrolysis performance thereof, before it is mounted on the outer tub 2. Then, the pair of water communication paths 34, 35 are externally press-fitted in the connection ports 67 of the outer tub 2 with the intervention of the packings 81. The fixing portions 80 of the electrolyzing chamber 32 are respectively fixed to the bosses 68 of the outer tub 2 by screws. The terminals 84 of the electrodes 33 are electrically connected to the energization circuit 30. Further, the water treatment unit 60 can be removed from the outer tub 2 by performing the aforesaid operations in a reverse order. Thus, the maintenance operation and the disassembling operation for the recycling can be facilitated.

Since the water treatment unit 60 is thus provided on the outside of the outer tub 2, the mounting operation for mounting the water treatment unit 60 on the outer tub 2, the maintenance operation for the water treatment unit 60 and the disassembling operation for the recycling can easily be performed from the outside of the outer tub 2. If the electrodes 33 were disposed between the outer tub 2 and the inner tub 5, there would be a need for an additional space in the outer tub 2 and additional water to be retained in the space. Where the water treatment unit 60 is mounted on the outer surface of the outer tub 2, on the other hand, the need for the additional space and the additional water is obviated.

It is herein merely necessary that the water treatment unit 60 which ensures easy implementation of the aforesaid operations is provided as a unit separate from the outer tub 2 and unitarily handled. For example, the water treatment unit 60 may include the pair of electrodes 33 and the fixing portions 80 for fixing the unit to the outer tub 2, and be adapted to electrolyze the water in use for the washing process by its own or in cooperation with the outer tub 2 to impart the water with a cleaning capability without addition of the detergent.

The water treatment unit 60 is detachable from the outer tub 2, so that the detaching operation can highly conveniently be performed. Where the electrodes 33 contain a precious metal, easy recycling is advantageously ensured.

Since the water treatment unit 60 incorporates the electrolyzing chamber 32 and the pair of electrodes 33, the water treatment unit 60 can unitarily be handled for the mounting and maintenance operations. Thus, these operations can further be facilitated.

Since the electrodes 33 are supported at the opposite sides thereof within the box-shaped electrolyzing chamber 32, the water treatment unit 60 can be handled without careful attention. Therefore, the assembling, maintenance and disassembling operations can further be facilitated. In addition, there is no possibility that the electrodes 33 are displaced or dislodged in the electrolyzing chamber 32 due to the vibrations of the outer tub 2 during the dehydrating operation.

With the packings 81 provided between the water treatment unit 60 and the outer tub 2, dimensional errors in the outer tub 2 and the corresponding portion of the water treatment unit 60 can be accommodated by elastic deformation of the packings 81 when the water treatment unit 60 is mounted on the outer tub 2, so that the mounting can easily be achieved. In addition, the sealing of the gap between the water treatment unit 60 and the outer tub 2 can be achieved. Therefore, bonding for the sealing can be obviated, so that labor for the assembling operation can be alleviated and the detaching and disassembling operations can be facilitated.

By the provision of the pair of water communication paths 34, 35, the water inlet path and the water outlet path between the electrolyzing chamber 32 and the outer tub 2 can be separated, whereby the water is caused to efficiently flow between the electrolyzing chamber 32 and the outer tub 2. Thus, the treated water can be supplied into the outer tub 2 for effective use in the washing process without wastage, so that the cleaning capability and the sterilizing capability can be enhanced. Further, the water from the outer tub 2 is caused to flow within the electrolyzing chamber 32 for efficient electrolysis.

The pair of water communication paths 34, 35 are spaced apart from each other, so that the treated water is prevented from flowing back into the electrolyzing chamber 32 immediately after flowing out of the electrolyzing chamber 32.

The pair of water communication paths 34, 35 are provided at different vertical positions of the thin-box-shaped electrolyzing chamber. 32 provided on the outer surface 66 of the outer tub 2, so that the stagnation of the water and the trapping of air can be suppressed. Thus, the water is caused to flow vertically (in a direction indicated by an arrow in FIG. 3) for efficient electrolysis.

Where the water flows upward in the electrolyzing chamber 32, the provision of the upper water communication path 34 at the inclined upper portion 69 of the electrolyzing chamber 32 permits the water flowing upward in the electrolyzing chamber 32 to be guided along the inclination into the upper water communication path 34 to speedily flow out, thereby facilitating the water flow. The lower water communication path 35 provided at the lower end of the electrolyzing chamber 32 prevents the stagnation of the water in the electrolyzing chamber 32. This advantageously facilitates the water flow in the electrolyzing chamber 32.

It is preferred that the electrodes 33 are thus provided in a space where the water flows to ensure efficient electrolysis. It is particularly preferred that the electrodes 33 are provided in a space where the water is circulated with respect to the outer tub 2. Thus, the use efficiency of the electrolyzed water can be enhanced. For example, it is conceivable that a circulation mechanism is provided for forcibly circulating the water by sucking the water from the outer tub 2 through an inlet thereof and discharging the water through an outlet thereof, and the electrodes 33 are provided in the circulation mechanism. The circulation mechanism may comprise a tubular water passage for water communication between an upper portion and a lower portion of the outer tub 2, and an electric pump for causing the water to pass through the water passage. The construction of such a circulation mechanism is disclosed in Japanese Patent Application No. 2000-196894 and the like filed by the applicant of the present invention. Besides, a known construction for the water circulation may be employed.

Since the electrolyzing chamber 32 has a thin box shape having a smaller depth with respect to the outer surface of the outer tub 2, the projection of the water treatment unit 60 from the outer surface of the outer tub 2 can be reduced. Where the electrolyzing chamber 32 is of a thin type fitted on the outer side surface 66 as the outer surface of the outer tub 2, for example, an increase in the size of the housing 1 is suppressed which may be required for prevention of the bump of the water treatment unit 60 against the housing 1 during the dehydrating operation as described above. Thus, space saving can be achieved. Where the electrolyzing chamber 32 is of a thin type fitted on the bottom 64 as the outer surface of the outer tub 2, the piping arrangement for the drainage of used water from the electrolyzing chamber 32 can be simplified, thereby achieving space saving.

Where the electrolyzing chamber 32 is provided below the outer tub 2, e.g., below the bottom 64 and the outer side surface 66, water retained at a lower water level within the outer tub 2 can also be utilized. For example, the electrolyzing process can be started in the midst of the water supply to the outer tub 2, so that the time required for the electrolysis can be reduced. Further, a course in which the electrolyzed water is utilized at a lower water level can be realized.

Where the electrolyzing chamber 32 is provided on the outer side surface 66 of the outer tub 2 and the water communication path 35 is provided at the lower end of the electrolyzing chamber 32, the water in the electrolyzing chamber 32 is allowed to flow out into the outer tub 2 through the water communication path 35 during the water drainage from the outer tub 2.

It is also conceivable that at least a part of the electrolyzing chamber 32 is formed integrally with the outer tub 2. In this case, the electrolyzing chamber 32 is preferably provided so as to project outward from the outer surface of the outer tub 2 or to be recessed along the inner surface of the outer tub 2. Thus, the interior configuration of the outer tub 2 can generally properly be maintained, thereby preventing reduction in space efficiency within the outer tub 2 and increase in water consumption more than necessary. Where the inner surface of the electrolyzing chamber 32 and the inner surface of the outer tub 2 are continuous, these inner surfaces are preferably inclined with respect to each other to facilitate the water flow between the inside of the outer tub 2 and the inside of the electrolyzing chamber 32.

In the meantime, the water from the outer tub 2 is often contaminated with lint. If the lint adheres on the electrodes 33, there is a fear that the durability of the electrodes 33 and the electrolysis efficiency are reduced. Therefore, a problem associated with the lint entering into the water treatment unit 60 is solved in the following manner.

Corner portions 82 of the electrodes 33 each have an R-shape 83 (partly shown in FIG. 4). Thus, the electrodes 33 have no corner edge, so that the lint is less liable to be caught on the corner portions of the electrodes 33 and easily released. Even if the lint is caught on the corner portions 82, the lint is naturally released from the corner portion 82 by the water streams.

The R-shape 83 includes an R-shape as seen perpendicularly to the plate surface of the electrode 33, and an R-shape as seen along the plate surface of the electrode 33. At least some of the corner portions maybe rounded, but it is preferred that more of the corner portions, particularly, all the corner portions, are rounded.

The spacing (D3) between the electrodes 33 is determined so as to prevent the lint from being caught therebetween. The spacing is preferably not smaller than 2 mm, for example. If the spacing is smaller than 2 mm, the lint is liable to be caught. Further, a spacing (D4) between the electrode 33 and the electrolyzing chamber 32 may be the same as the aforesaid spacing, or zero. That is, there may be no gap between the electrodes and the electrolyzing chamber 32.

This prevents reduction in water fluidity due to adhesion of the lint. This also prevents the lint from hindering the contact of the water with the electrodes 33. As a result, the reduction in electrolysis efficiency due to the lint can be prevented, so that the electrolysis efficiency can be maintained at a higher level. Since the lint is permitted to enter the water treatment unit 60, there is no need for provision of a lint filter and maintenance against the lint.

As shown in FIG. 2, the washing machine may have an air bubble generator 88 for generating air bubbles from the bottom 64 of the outer tub 2 for enhancement of the cleaning capability. Where the air bubble generator 88 and the water treatment unit 60 are used in combination, the electrolysis can be achieved more efficiently.

The air bubble generator 88 includes an air pump 89, an air hose 90 connected to an air outlet of the air pump 89 for air supply, and a nozzle (not shown) connected to an end of the air hose 90 for ejecting air into the outer tub 2. When the air bubble generator 88 is actuated in the washing process, the air is ejected from the nozzle, and flows into the inner tub 5 through the perforations of the inner tub 5 to generate air bubbles below the pulsator 7. The air bubbles are agitated by the rotating pulsator 7, and broken into a multiplicity of minute air bubbles. When the minute air bubbles are brought into contact with the laundry, the minute air bubbles are broken to generate ultrasonic waves. At this time, shock waves within an ultrasonic range are generated, thereby promoting removal of dirt components adhering onto the laundry. Thus, the cleaning capability can be enhanced as compared with a case where air bubbles are not applied.

The air bubble generator 88 has a function as air supplying means for supplying air into the electrolyzing chamber 32 from a lower portion 70 of the electrolyzing chamber 32 in addition to the originally intended function for enhancing the cleaning capability. The air supplying means generates water streams by promoting upward water flow within the electrolyzing chamber 32 of the water treatment unit 60. The air hose 90 is branched in a middle portion thereof. One branch extends to the nozzle, and the other branch is connected to the electrolyzing chamber 32.

A single air supply port 91 is provided in the lower portion 70 of the electrolyzing chamber 32 so as to be supplied with the air from the air hose 90 as shown in FIG. 4. A plurality of air supply ports 91 maybe provided. The air pump 89 is actuated in the electrolyzing process. The air supplied into the electrolyzing chamber 32 from the air supply port 91 is broken into air bubbles E, which float in the electrolyzing chamber 32 to flow into the outer tub 2 through the upper water communication path 34 (in a direction indicated by a one-dot-and-dash line in FIG. 4). Correspondingly, the water retained in the electrolyzing chamber 32 is caused to flow by the flow of the air (in a direction indicated by a broken line in FIG. 4). Particularly, where the upper portion 69 of the electrolyzing chamber 32 is inclined and the water communication path 34 is located at the higher position, the air bubbles can quickly flow out of the electrolyzing chamber 32, so that the water flow can further be facilitated. There is no possibility that the air bubbles are trapped between the electrodes 33. As a result, the electrolysis efficiency can be enhanced. Therefore, a voltage required to provide a predetermined electrolyzing capability can be reduced, thereby realizing reduction in size, cost and power consumption of the electrical components such as the transformer 61.

The air supply port 91 is disposed so as not to overlap with the electrodes 33 as seen in plan and so as not to face toward the electrodes 33. Thus, the air can be supplied without contact with the electrodes 33. Therefore, reduction in electrolysis efficiency due to the air can be suppressed. It is preferred that the air supply port 91 is horizontally spaced a predetermined distance from edges of the electrodes 33 in a corner of the bottom face portion 76 of the electrolyzing chamber 32. The predetermined distance is a distance such as not to permit the contact of the air with the electrodes 33, for example, 10 mm.

The air supply port 91 and the upper water communication path 34 are disposed at diagonally opposite positions as seen from the front side. Thus, the air can flow a longer distance in the electrolyzing chamber 32, so that the water flow can be facilitated. The air supply port 91 and the lower water communication path 35 are disposed at laterally separate positions as seen from the front side. Thus, water present in a position remote from the lower water communication path 35 is caused to easily flow, which may otherwise have a difficulty in flowing.

Thus, the water flow in the electrolyzing chamber 32 can be facilitated for efficient electrolysis. In addition, the air is introduced into the outer tub 2 for improvement of the cleaning capability. The aforesaid air pump 89 may be adapted to supply the air only to the electrolyzing chamber 32. Referring back to FIG. 1, the following explanation is directed to a case where the air bubble generator 88 is not provided.

A top plate 18 is provided on a top face of the housing 1. The top plate 18 has a laundry loading port 18*a* provided in a center portion thereof. The loading port 18*a* is covered with an openable upper lid 19. An operation panel 48 is provided in front of the top plate 18.

Figure 5:
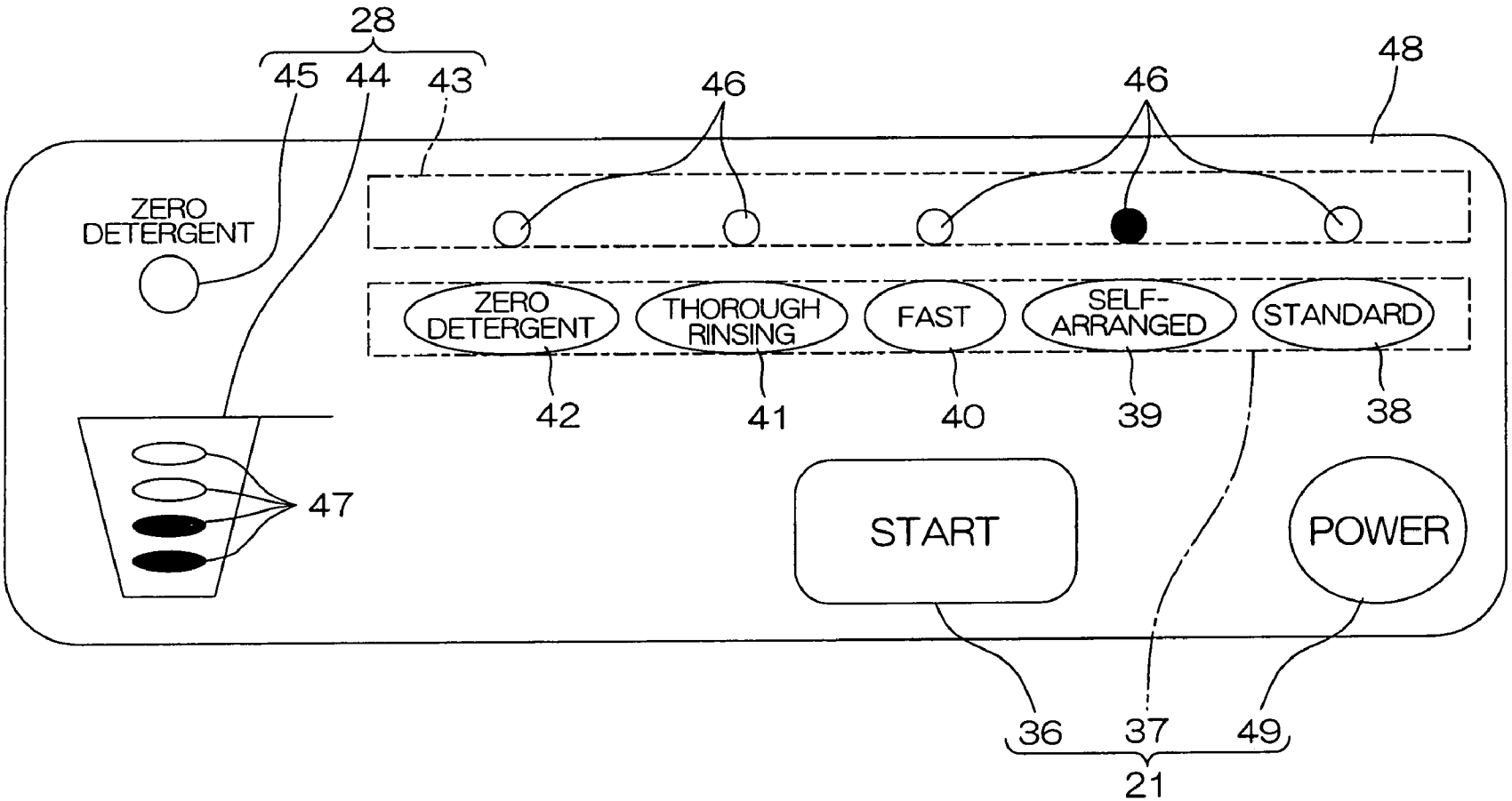
FIG. 5 is a plan view of an operation panel for illustrating the constructions of an operation section and a display section.

FIG. 5 is a plan view of the operation panel 48. The operation panel 48 includes an operation section 21 and a display section 28. The operation section 21 has a power supply key 49 for turning on power supply to the machine, a start key 36 for starting a washing process, and a set of course keys 37 (selecting means) for selecting a washing course. The course key set 37 includes a standard course key 38 for selecting a standard course, a self-arranged course key 39 for selecting a self-arranged course, a fast course key 40 for selecting a fast course, a thorough rinsing course key 41 for selecting a thorough rinsing course, and a zero detergent course key 42 for selecting a zero detergent course.

The standard course is a washing course in which a standard washing process is performed. The self-arranged course is a washing course in which a washing process is performed according to a procedure set by a user (manually set procedure). The fast course is a washing course in which a washing process time is short. The thorough rinsing course is a washing course in which a rinsing operation is thoroughly performed by increasing a rinsing operation period and the number of times of the rinsing operation. These courses employ a detergent. In these courses, water containing the detergent (detergent solution) is retained in the outer tub 2 and the laundry is washed by generating water streams by the rotation of the pulsator 7. These courses are collectively referred to as a first washing course.

The zero detergent course employs no detergent. In this course, water retained in the outer tub 2 is electrolyzed by the electrolyzing device 31 for production of electrolyzed water, and the laundry is washed by generating water streams by the rotation of the pulsator 7. The zero detergent course is referred to as a second washing course.

The display section 28 includes a course display section 43 for displaying a selected washing course, a detergent amount display section 44 (information means) for displaying the amount of the detergent corresponding to the load of the laundry, and a zero detergent display section 45 (second information means) for indicating addition of no detergent by lighting an LED. In the course display section 43, LEDs 46 are provided in the vicinity of the respective course keys, and one of the LEDs corresponding to the selected washing course is lighted. In the detergent amount display section 44, a plurality of LEDs 47 are provided in an illustration of a detergent measure cup, and a number of LEDs 47 corresponding to the amount of the detergent are lighted for indication of the detergent amount.

Figure 6:
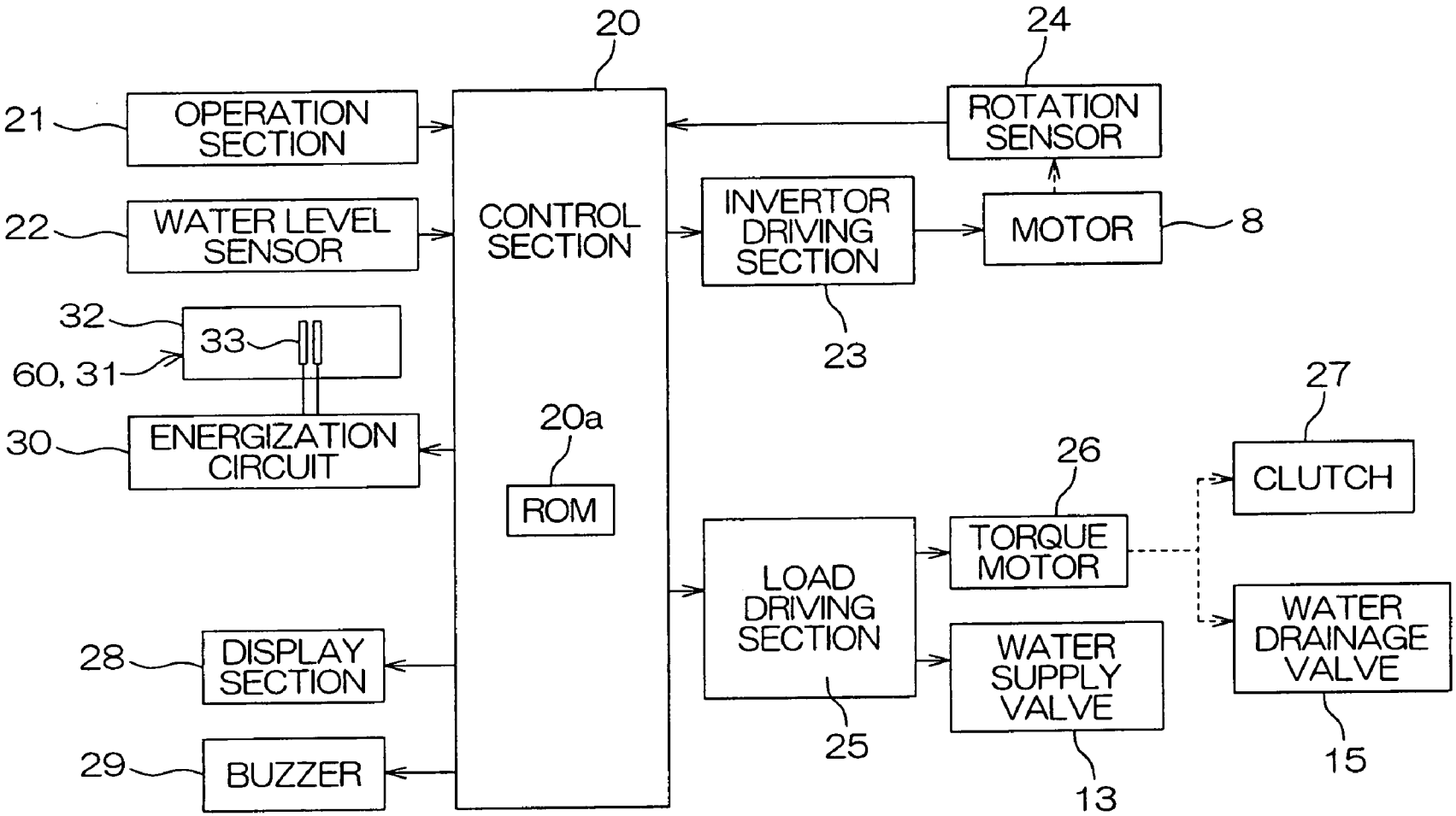
FIG. 6 is a diagram illustrating the electrical construction of the fully automatic washing machine according to the embodiment.

FIG. 6 is a diagram illustrating the electrical construction of the fully automatic washing machine according to this embodiment. A control center is a control section 20 including a CPU, a RAM, a ROM, a timer and the like. The control section 20 is comprised of a microprocessor. An operation signal is inputted to the control section 20 from the operation section 21. A water level detection signal is inputted to the control section from a water level sensor 22 for detecting the level of the water contained in the outer tub 2. The control section 20 controls the rotation of the motor 8 via the invertor driving section 23, and controls the operation of the torque motor 26 and the operation of the water supply valve 13 via a load driving section 25. The torque motor 26 controls the operation of the clutch 27 and the operation of the water drainage valve 15 as described above. Further, the control section 20 controls the operation of the display section 28 and the operation of a buzzer 29 for notifying the end of the process and an abnormality in the process. The motor 8 is provided with a rotation sensor 24 for outputting pulse signals according to the rotation thereof, and the pulse signals are inputted to the control section 20. The rotation sensor 24 is provided for detecting the rotation speed of the motor 8, i.e., the rotation speed of the inner tub 5.

The pair of electrodes 33 are connected to an output side of the control section 20 via the energization circuit 30 including the transformer 61 and the like. When an energization signal is outputted from the control section 20, the energization circuit 30 is actuated for energization of the pair of electrodes 33.

Sequences for the respective washing courses are stored in the ROM 20*a* of the control section 20.

When a washing course is selected by the operation of the course key set 37, a sequence for the selected washing course is read out of the ROM 20*a*. Then, the control section 20 controls loads to be applied to the motor 8 and the like according to the sequence, and performs the washing process according to the selected washing course.

Figure 7:
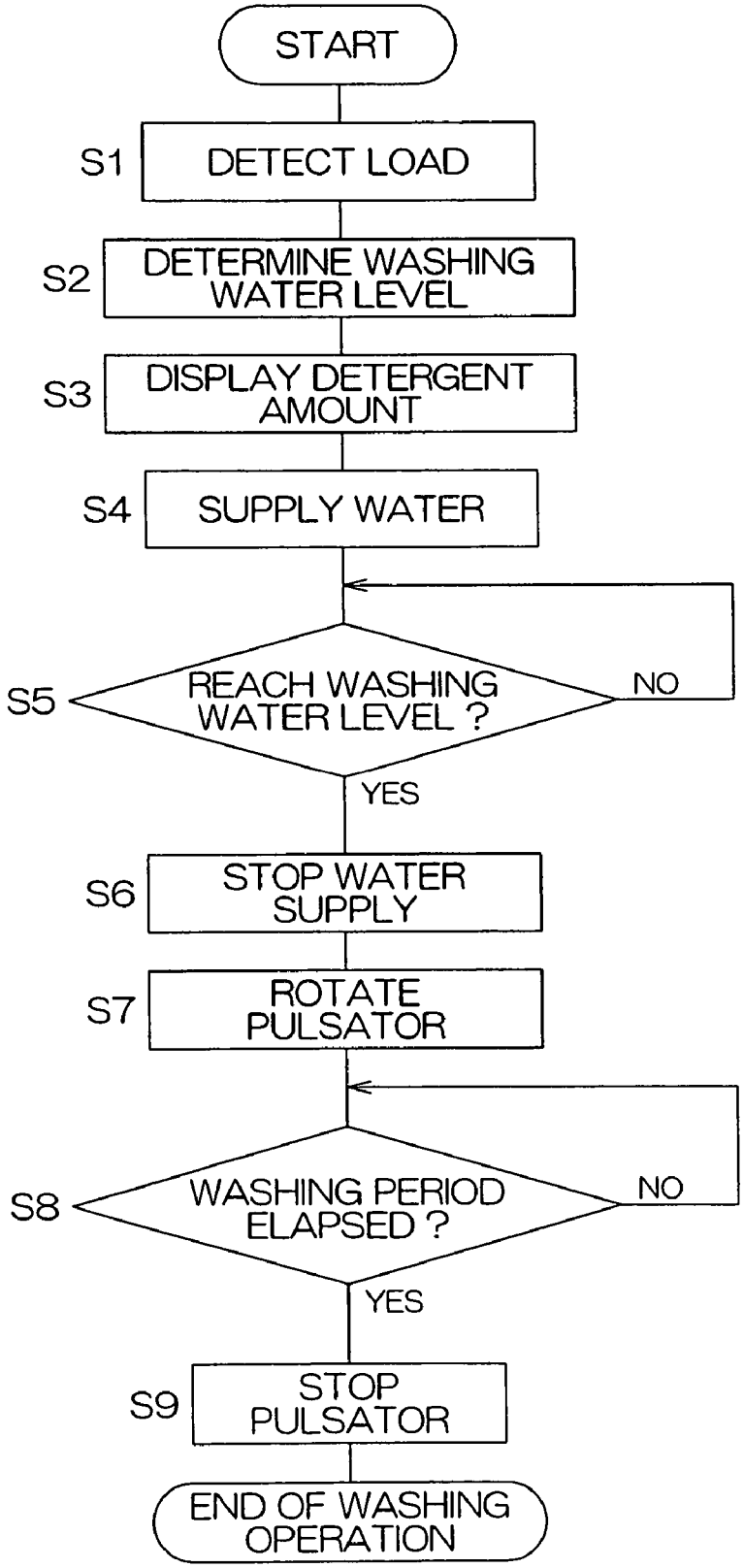
FIG. 7 is a flow chart for explaining a washing process in a standard course to be performed by the fully automatic washing machine according to the embodiment.

An explanation will be given to the operation of the fully automatic washing machine having the aforesaid construction according to this embodiment. With reference to a flow chart in FIG. 7, there will first be described a case where a user selects the standard course which is a typical washing course employing a detergent.

When the start key 36 is pressed to provide a command for the start of the washing process, the load or the amount of laundry loaded in the inner tub 5 is detected prior to the supply of water (Step S1). More specifically, the pulsator 7 is rotated for a short period of time, and the load is determined on the basis of a period during which the consequent inertial rotation continues. In this case, load detection means is constituted by the pulsator 7 and the control section 20. Of course, the detection of the load is not limited to this method, but any other method may be employed.

Next, a washing water level is determined according to the detected load (Step S2), and a detergent amount corresponding to the load is displayed on the detergent amount display section 44 (Step S3). In view of the display in the detergent amount display section 44, a user adds a proper amount of a detergent into the inner tub 5.

In turn, the supply of tap water is started, and the water is supplied to the determined washing water level (Steps S4 to S6). Thus, a detergent solution obtained by dissolving the detergent in the tap water is contained in the outer tub 2.

Subsequently, the pulsator 7 is rotated at a predetermined speed in one direction or in opposite directions, whereby water streams are generated in the outer tub 2 for washing the laundry (Step S7). Dirt adhering to the laundry is removed by the effects of the detergent and the water streams. After a lapse of a predetermined washing period, the pulsator 7 is stopped to end the washing operation (Steps S8, S9).

After the washing operation is completed, a first intermediate dehydrating operation, a first rinsing operation, a second intermediate dehydrating operation, a second rinsing operation and a final dehydrating operation are sequentially performed. Thus, the washing process is completed.

Figure 8:
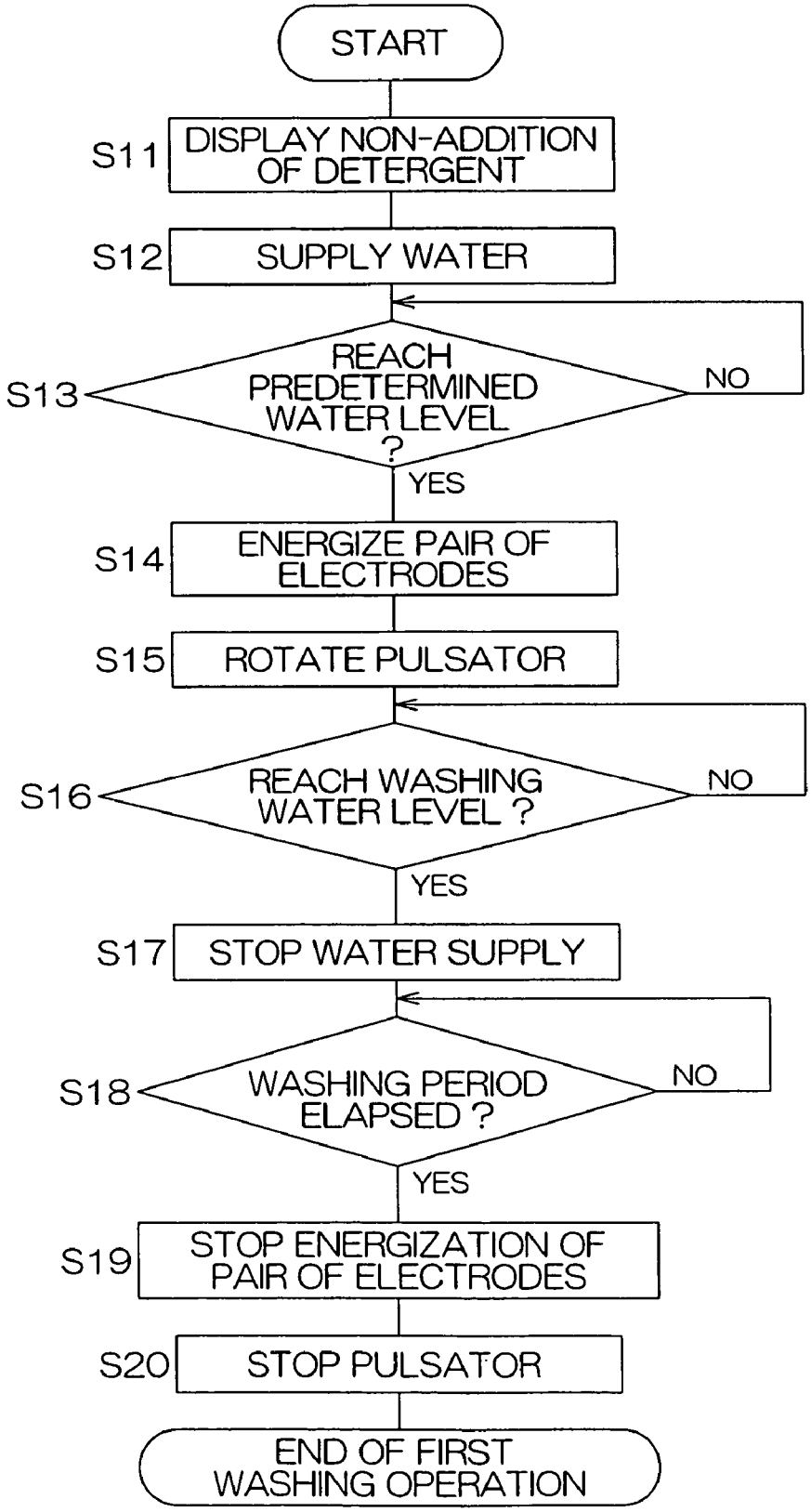
FIG. 8 is a flow chart for explaining a washing process in a zero detergent course to be performed by the fully automatic washing machine according to the embodiment.

With reference to a flow chart in FIG. 8, an explanation will be given to a case where the user selects the zero detergent course which employs no detergent.

When the start key 36 is pressed to provide a command for the start of the washing process, the LED of the zero detergent display section 45 is lighted instead of the display in the detergent amount display section 44 (Step S11). Thus, the user is notified that no detergent is added.

Then, the supply of tap water is started (Step S12) The water is supplied to a predetermined washing water level (more specifically a lower water level) for the zero detergent course. When the water level in the outer tub 2 reaches a predetermined level which is lower than the washing water level and permits the pair of electrodes 33 of the electrolyzing device 31 to be submerged in the water, the electrolyzing device 31 is actuated, i.e., the pair of electrodes are energized (Steps S13, S14). Further, the pulsator 7 is rotated at a predetermined speed in one direction or in opposite directions to generate water streams in the outer tub 2 (Step S15).

The tap water contains very small amounts of impurities such as iron, calcium, magnesium and chlorine. Therefore, electrolyzed water is produced through the electrolyzing process performed in the electrolyzing chamber 32, and the tap water goes back and forth between the electrolyzing chamber 32 and the outer tub 2, whereby the outer tub 2 is gradually filled with the electrolyzed water. The electrolyzed water has a weak alkalinity. Further, active oxygen as well as hypochlorous acid (HClO) and hypochlorous ions (ClO—) are generated in the electrolyzed water in the electrolyzing chamber 32. Together with the electrolyzed water, hypochlorous acid and hypochlorous ions flow into the outer tub 2. In the outer tub 2, dirt adhering to the laundry is removed by the effect of the alkaline water and the effect of the water streams. Further, the laundry is sterilized by the effect of hypochlorous acid and hypochlorous ions. The dirt removed from the laundry is decomposed by the effect of the active oxygen in the electrolyzing chamber 32, and prevented from adhering again to the laundry.

When the water reaches the washing water level, the water supply is stopped (Steps S16, S17). On the other hand, the operation of the electrolyzing device 31 and the operation of the pulsator 7 are continued. After a lapse of a predetermined washing period, the operation of the electrolyzing device 31 (the energization of the pair of electrodes 33) is stopped, and the pulsator 7 is stopped for completion of the first washing operation (Steps S18 to S20).

After an intermediate dehydrating operation is performed, a second washing operation is performed in the same manner as the first washing operation. Upon completion of the second washing operation, a final dehydrating operation is performed. Thus, the washing process in the zero detergent course is completed.

In the washing course employing the detergent, e.g., in the standard course, the electrolyzing device 31 may be operated in the rinsing operations (first and second rinsing operations), so that the electrolyzed water is employed for rinsing the laundry. Thus, the laundry can be sterilized while being rinsed.

An automatic detergent adding device (adding means) may be provided for automatically adding a proper amount of the detergent according to the detected load. Thus, the detergent is automatically added in the washing course employing the detergent, e.g., in the standard course, and no detergent is added in the zero detergent course. A conventionally known device may be used as the automatic detergent adding device and, therefore, no explanation will be given to the construction thereof.

While the embodiment of the present invention has thus been described, it should be understood that the invention be not limited to the above-described embodiment as will be described below.

The washing machine according to the present invention is not limited to the fully automatic washing machine. The invention is applicable to a so-called drum type washing machine in which the washing tub is constituted by an outer tub and a drum of horizontal axis type provided in the outer tub. Further, the invention is applicable to a so-called double tub washing machine in which a single washing tub is provided separately from a dehydration tub.

The water treatment means according to the present invention is not limited to the electrolyzing device, but any treatment means may be employed which performs a specific treatment on tap water to impart the tap water with the cleaning capability. Further, the present invention is not limited to the electrolysis of the tap water alone. For promotion of the electrolysis of the tap water, the electrolyzing process may be performed on an electrolytic solution prepared by adding salt or sodium hydrogencarbonate to the tap water.

The water stream generating means according to the present invention is not limited to the pulsator. For example, the water streams may be generated by rotating the inner tub. In this case, the inner tub serves as the water stream generating means. What is important is that the water stream generating means is capable of generating water streams within the washing tub.

The information means and the second information means according to the present invention are not limited to the display means such as the detergent amount display section and the zero detergent display section. For example, means for notifying the amount of the detergent and the non-addition of the detergent by voice may be employed.

It should be understood that the present invention be not limited to the embodiment described above, but various modifications may be made within the scope of the present invention as defined by the appended claims.

This application claims priority benefits under the Convention on the basis of Japanese Patent Applications No. 2001-106923 and No. 2001-133254 filed with the Japanese Patent Office on Apr. 5, 2001 and on Apr. 27, 2001, respectively, the disclosure thereof being incorporated herein by reference.

What is claimed is:

1. An electric washing machine comprising:

a washing tub to contain laundry;

water motion generating means to generate water motion in the washing tub;

water treatment means to perform a specific treatment on tap water to be supplied into the washing tub or tap water supplied into the washing tub to impart the water with a cleaning capability without addition of a detergent;

storage means which stores therein a sequence for a first washing course in which the laundry is washed by generating water motion in the washing tub which contains a detergent solution prepared by adding the detergent into the tap water, and a sequence for a second washing course in which the laundry is washed without the use of the detergent by generating water motion in the washing tub which contains a cleaning liquid imparted with the cleaning capability by treating the tap water by the water treatment means;

selecting means to allow a user to select the first washing course or the second washing course;

control means to control operations of the water motion generating means and the water treatment means on the basis of the sequence for the washing course selected by the selecting means to perform a washing process in the selected washing course;

load detecting means to detect a load of the laundry; and information means to notify a detergent amount according to the load detected by the load detecting means, wherein the control means actuates the load detecting means of the detection of the load and causes the information means to notify the detergent amount according to the detected load in the washing process of the first washing course, and prohibits the information means from notifying the detergent amount in the washing process of the second washing course.

2. An electric washing machine as set forth in claim 1, wherein the water treatment means comprises a pair of electrodes for electrolysis of the tap water, and produces the cleaning liquid by electrolyzing the tap water through energization of the pair of electrodes.

3. An electric washing machine as set forth in claim 1, further comprising:

second information means to notify that no detergent is added, wherein the control means actuates the second information means in the washing process of the second washing course.

4. An electric washing machine as set forth in claim 3, wherein the water treatment means comprises a pair of electrodes for electrolysis of the tap water, and produces the cleaning liquid by electrolyzing the tap water through energization of the pair of electrodes.

5. An electric washing machine comprising:

a washing tub to contain laundry;

water motion generating means to generate water motion in the washing tub;

water treatment means to perform a specific treatment on tap water to be supplied into the washing tub or tap water supplied into the washing tub to impart the water with a cleaning capability without addition of a detergent;

storage means which stores therein a sequence for a first washing course in which the laundry is washed by generating water motion in the washing tub which contains a detergent solution prepared by adding the detergent into the tap water, and a sequence for a second washing course in which the laundry is washed without the use of the detergent by generating water motion in the washing tub which contains a cleaning liquid imparted with the cleaning capability by treating the tap water by the water treatment means;

selecting means to allow a user to select the first washing course or the second washing course;

control means to control operations of the water motion generating means and the water treatment means on the basis of the sequence for the washing course selected by the selecting means to perform a washing process in the selected washing course;

load detecting means to detect a load of the laundry; and adding means to add the detergent in an amount according to the load detected by the load detecting means, wherein the control means actuates the load detecting means to detect the load and causes the adding means to add the detergent in the amount according to the detected load in the washing process of the first washing course, and prohibits the adding means from adding the detergent in the washing process of the second washing course.

6. An electric washing machine as set forth in claim 5, wherein the water treatment means comprises a pair of electrodes for electrolysis of the tap water, and produces the cleaning liquid by electrolyzing the tap water through energization of the pair of electrodes.

* * * * *